US008601771B2

(12) United States Patent
Folk et al.

(10) Patent No.: US 8,601,771 B2
(45) Date of Patent: Dec. 10, 2013

(54) AUTOMATIC STRAPPING AND BAGGING OF FUNDS

(75) Inventors: Amy Baker Folk, Charlotte, NC (US); William Thomas Sanders, Denver, NC (US); Daniel Christopher Bohen, Charlotte, NC (US); Shane Anthony Johnson, Charlotte, NC (US)

(73) Assignee: Bank of America Corporation, Charlotte, NC (US)

( * ) Notice: Subject to any disclaimer, the term of this patent is extended or adjusted under 35 U.S.C. 154(b) by 106 days.

(21) Appl. No.: 13/228,487

(22) Filed: Sep. 9, 2011

(65) Prior Publication Data

US 2012/0065771 A1 Mar. 15, 2012

Related U.S. Application Data

(62) Division of application No. 12/241,181, filed on Sep. 30, 2008, now Pat. No. 8,056,305.

(51) Int. Cl.

| | |
|---|---|
| ***B65B 57/10*** | (2006.01) |
| ***B65B 5/06*** | (2006.01) |
| ***B65B 61/20*** | (2006.01) |

(52) U.S. Cl.
USPC ..... 53/410; 53/447; 53/469; 53/501; 53/540; 53/284.7

(58) Field of Classification Search
USPC ..... 53/399, 447, 541, 589, 590, 495, 501, 53/410, 469, 540, 284.7
See application file for complete search history.

(56) References Cited

U.S. PATENT DOCUMENTS

| | | | | |
|---|---|---|---|---|
| 4,113,140 | A | 9/1978 | Graef et al. | |
| 4,186,477 | A | 2/1980 | Cary et al. | |
| 4,313,601 | A | 2/1982 | Graef et al. | |
| 4,369,360 | A | 1/1983 | Tsuji | |
| 4,622,456 | A | 11/1986 | Naruto et al. | |
| 4,784,274 | A | 11/1988 | Mori et al. | |
| 4,802,325 | A * | 2/1989 | Duncan | 53/444 |
| 4,820,909 | A | 4/1989 | Kawauchi et al. | |
| 4,910,944 | A | 3/1990 | Segalowitz et al. | |
| 5,022,531 | A * | 6/1991 | Horino et al. | 209/552 |
| 5,411,249 | A | 5/1995 | Zouzoulas | |
| 5,680,472 | A | 10/1997 | Conant | |
| 5,931,634 | A * | 8/1999 | Neri | 414/790 |
| 5,996,314 | A | 12/1999 | Pennini et al. | |
| 6,278,795 | B1 | 8/2001 | Anderson et al. | |
| 6,513,303 | B2 * | 2/2003 | Neri | 53/399 |
| 6,550,221 | B1 * | 4/2003 | Neri | 53/399 |
| 7,334,381 | B2 * | 2/2008 | Mertz et al. | 53/397 |
| 2005/0011721 | A1 | 1/2005 | Armanini et al. | |
| 2007/0102439 | A1 * | 5/2007 | Bell | 220/789 |
| 2008/0236101 | A1 * | 10/2008 | Horiuchi | 53/399 |

* cited by examiner

*Primary Examiner* — Stephen F Gerrity
(74) *Attorney, Agent, or Firm* — Banner & Witcoff, Ltd.; Michael A. Springs

(57) ABSTRACT

A cash recycler or other currency handling device includes modules for automatically strapping a plurality of bills together and bagging the strapped bills for transport. A user may determine a number of bills to be bundled in a stack or unit. Once the predetermined threshold is met, the bills will be automatically transferred to a strapping area where the bills will be strapped together for storage or transport. Additionally or alternatively, the bills may be strapped together as they enter a cartridge, such as an overflow cartridge. The strapped bills may be transferred to a bagging module where the stacks of bills will be automatically bagged, each bag including a predetermined number of stacks of bills. The bags will then be transferred to storage for transport.

23 Claims, 13 Drawing Sheets

AUTOMATIC STRAPPING AND BAGGING OF FUNDS

RELATED APPLICATIONS

This application is a division of U.S. patent application Ser. No. 12/241,181, filed Sep. 30, 2008, now U.S. Pat. No. 8,056,305, entitled "Automatic Strapping and Bagging of Funds". The above mentioned application is incorporated herein by reference in its entirety.

BACKGROUND

Cash flow refers to the movement of cash over a particular time period within a business or enterprise. The calculation of cash flow may be used as one measure to gauge financial health of the business. Managers in charge of cash flow management may use various tools to assist in making decisions involving cash flow including cash recyclers which allow a retail establishment to maintain and re-use an amount of currency on-site. The cash recycler may further calculate and manage use of cash flows in real-time.

While cash recyclers allow a business to manage their cash flows in a more seamless manner, cash recyclers often must be attended to in order to maintain a reasonable amount of currency and storage space in the recycler. For instance, currency and or checks, and the like should be removed from the recycler periodically to provide additional storage in the recycler and prevent too much cash from accumulating in the recycler which can be a security risk. Removal of the currency often requires the cash to be bundled and manually bagged for transportation. This system may be time consuming and inefficient.

SUMMARY

The following presents a simplified summary in order to provide a basic understanding of some aspects of the invention. The summary is not an extensive overview of the invention. It is neither intended to identify key or critical elements of the invention nor to delineate the scope of the invention. The following summary merely presents some concepts of the invention in a simplified form as a prelude to the description below.

Aspects of the present disclosure relate to automatically strapping bundles of cash or other funds for storage and/or transportation. For instance, user input may be received indicating a predetermined number of bills to be bundled. Once that predetermined threshold is reached, the bills may be automatically transferred to a strapping module where the bills will be stacked and bundled into a unit automatically. The bundle or stack may then be transferred to storage or to another module.

Further aspects relate to automatically bagging strapped bundles of cash or other funds in anticipation of transportation of the funds. In one example, user input is received regarding a predetermined number of bundles to be placed in each bag or container. Alternatively, a number of bundles to be placed in each bag may be automatically determined. Once the threshold is reached, the automatic bagging process is initiated and the bundles are transferred to a bagging module. The predetermined number of bundles are placed in a bag and the bag is then transferred to storage or to a transportation storage area from where it will be removed from the cash recycler.

BRIEF DESCRIPTION OF THE DRAWINGS

The present disclosure is illustrated by way of example and not limited in the accompanying figures in which like reference numerals indicate similar elements.

The reader is advised that the attached drawings are not necessarily drawn to scale.

DETAILED DESCRIPTION

Aspects of the present disclosure relate to cash handling devices. Cash handling devices generally refer to devices that are configured to accept and/or dispense currency. Cash handling devices include payment kiosks, point of sale systems such as cash registers, automated teller machines (ATMs), currency recyclers and depository machines, and the like. Currency recyclers generally refer to cash handling devices that are configured to dispense the same currency that was earlier deposited. For example, if a user deposits a 5 dollar bill into a cash recycler machine, the same 5 dollar bill may be dispensed during a subsequent withdrawal transaction. Thus, using currency recyclers, deposited currency may be placed immediately back into use and circulation instead of being held or frozen until a bank is able to collect and reconcile the funds, stored indefinitely and/or taken out of circulation entirely as is the case with other current cash handling devices.

Figure 1:
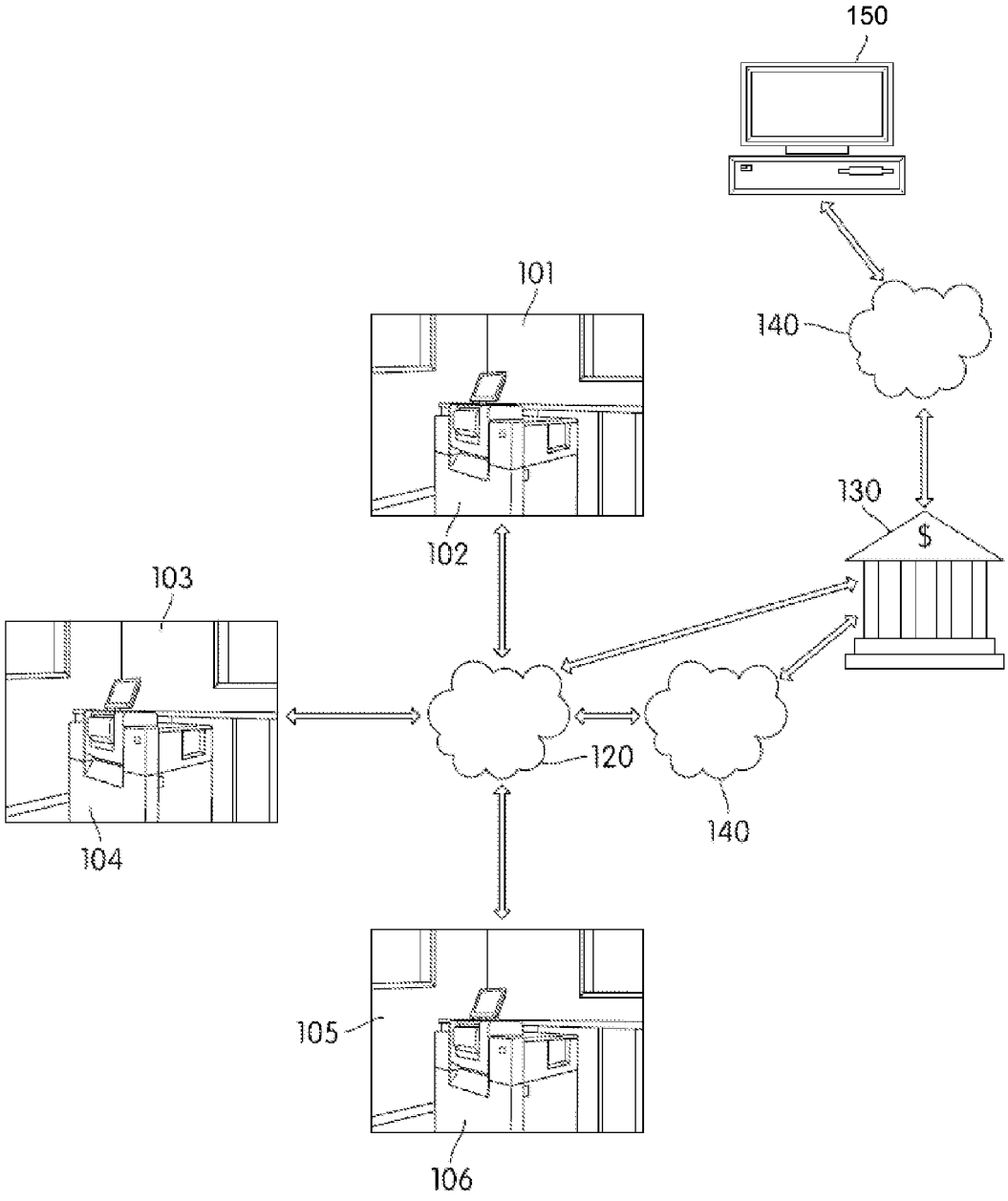
FIG. 1 illustrates an example of a suitable operating environment in which various aspects of the disclosure may be implemented.

FIG. 1 illustrates an example of a suitable operating environment in which various aspects of the disclosure may be implemented. Devices 102, 104, 106 may include currency recyclers and/or other cash handling devices and may be located at various sites such as locations 101, 103, and 105. The locations may represent different stores of a business enterprise. For example, locations 101, 103, and 105 may represent three different grocery stores located in different geographical areas belonging to a grocery store chain. Those skilled in the art will realize that additional cash handling devices may be located in the same store or in other stores belonging to the grocery store chain. In addition, those skilled in the art will realize that a grocery store chain is only one illustrative example of the types of locations or businesses that cash handling devices such as recyclers may be located. For example, cash recyclers may also be located in gas stations, post offices, department stores, and other places where cash and other financial instruments are deposited or withdrawn.

FIG. 1 further illustrates that cash handling devices 102, 104, and 106 may be connected to a communications network such as communications network 120. Communications network 120 may represent: 1) a local area network (LAN); 2) a simple point-to-point network (such as direct modem-to-modem connection); and/or 3) a wide area network (WAN), including the Internet and other commercial based network services.

Cash handling devices 102, 104, and 106 may communicate with one another or with a financial institution such as bank 130 via communication network 120 in various manners. For example, communications between cash handling devices 102, 104, 106 and bank 130 may use protocols and networks such as TCP/IP, Ethernet, FTP, HTTP, BLUETOOTH, Wi-Fi, ultra wide band (UWB), low power radio frequency (LPRF), radio frequency identification (RFID), infrared communication, IrDA, third-generation (3G) cellular data communications, Global System for Mobile communications (GSM), or other wireless communication networks or the like. Communications network 120 may be directly connected to a financial institution such as bank 130. In another embodiment, communications network 120 may be connected to a second network or series of networks 140 before being connected to bank 130. According to one or more arrangements, bank 130 may utilize an infrastructure which includes a server 150 having components such as a memory, a processor, a display, and a communication interface.

Figure 2:
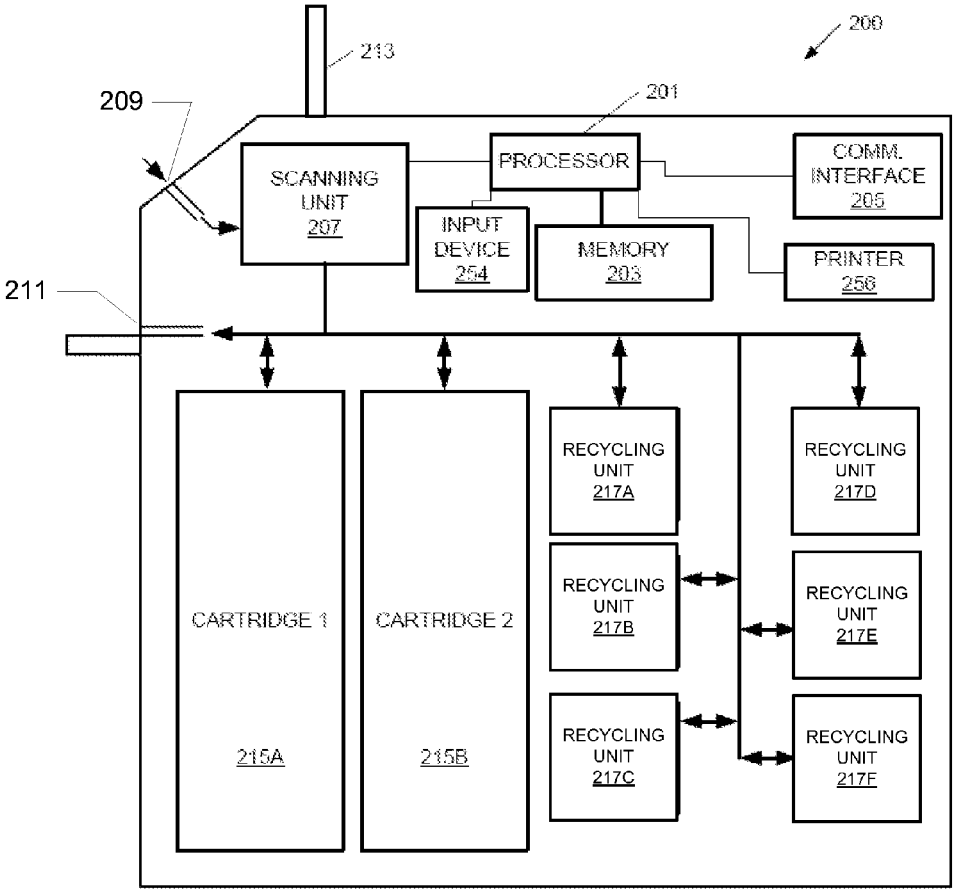
FIG. 2 illustrates a simplified diagram of a currency recycler in accordance with an aspect of the invention.

FIG. 2 illustrates a simplified diagram of a cash recycler that may be used in accordance with the operating environment of FIG. 1. Cash recycler 200 may include processor 201, memory 203, communication interface 205, scanning unit 207, display 213 and various cartridges 215 and recycling units, such as stackers, rolled store modules (RSMs), and the like stackers 217. Processor 201 may be generally configured to execute computer-readable instructions stored in memory 203 such that, for example, cash recycler 200 may send and receive information to and from a bank (e.g., bank 130 of FIG. 1) using communication interface 205 and via a network (e.g., networks 120 and/or 140 of FIG. 1). Memory 203 may be configured to store a variety of information including the aforementioned computer-readable instructions, funds balance data, reconciliation data, user account information and the like. Additionally, memory 203 may include non-volatile and/or volatile memory. One or more databases may be stored in the memories 108, 112, and 116.

Cash recycler 200 may further provide display 213 to present data and/or messages to a user. For example, display 213 may be configured to display a recycler balance, a transaction interface, a current deposit count, security options, transportation options and the like. One or more input devices 254 such as a keypad, keyboard, mouse, touchscreen, fingerprint scanner, retinal scanner, proximity card reader, RFID scanner and/or writer, magnetic card reader, barcode reader, and/or combinations thereof, or any other type of input device or reader capable of inputting, reading, or scanning indicia or information, may also be included in or connected to recycler 200. One or printers 256 may also be included in or connected to recycler 200 for printing receipts and notifications as well.

In cash recycler 200, recycling units 217 and cartridges 215 are configured to store currency. Currency may be inserted through input slot 209 and withdrawn through withdrawal slot 211. Recycling units 217 may be used to store and organize currency based on denomination. For example, all $5 bills may be stored in recycling unit 2 (i.e., recycling unit 217B) while all $20 bills may be stored in recycling unit 3 (i.e., recycling unit 217C). Cartridges 215A and 215B, on the other hand, may be used to store overflow currency and/or currency for transport or other inventory verification functions. Thus, if recycling units 217 become full, additional currency that is deposited into recycler 200 may be stored in an overflow cartridge such as cartridge 215B. One of cartridges 215 may be designated as a transport cartridge that stores currency to be withdrawn from the machine and transported to the bank. Alternatively or additionally, one or more of cartridges 215 may be used as an unfit bill store for currency determined to be defective to a degree that it should be taken out of circulation. Cartridges 215 and recycling units 217 may further be removable for easier access or transport.

Scanning unit 207 may be configured to scan each bill or currency that is inserted into recycler 200. Scanning unit 207 may be configured to detect defects, unauthorized reproductions, denomination, type of currency (e.g., which country the currency originates from) and the like. Scanning unit 207 may further be configured to refuse money (either through input slot 209 or withdrawal slot 211) if it cannot be properly recognized or if the currency is deemed to be an unauthorized reproduction. Scanning unit 207 may send such data to processor 201 which may, in turn, save the data in memory 203. In addition, scanning unit 207 may be configured to scan checks or other non-currency paper items, in addition to paper currency.

Further, recycler 200 may include one or more mechanical or electromechanical systems (not shown) for automatically transferring currency between recycling units 217, cartridges 215, input slot 209 and withdrawal slot 211 in recycler 200. For example, currency may automatically be withdrawn from recycling units 217 and directed into cartridge 215A for storage using a series of motorized rollers. In another example, currency stored in cartridge 215A may be withdrawn and organized and stored into recycling units 217 according to denomination. Using such systems to facilitate the automated movement of currency between storage components and other portions of recycler 200 may provide efficiency and security by alleviating some of the need to manually handle currency stored within recycler 200.

Figure 3:
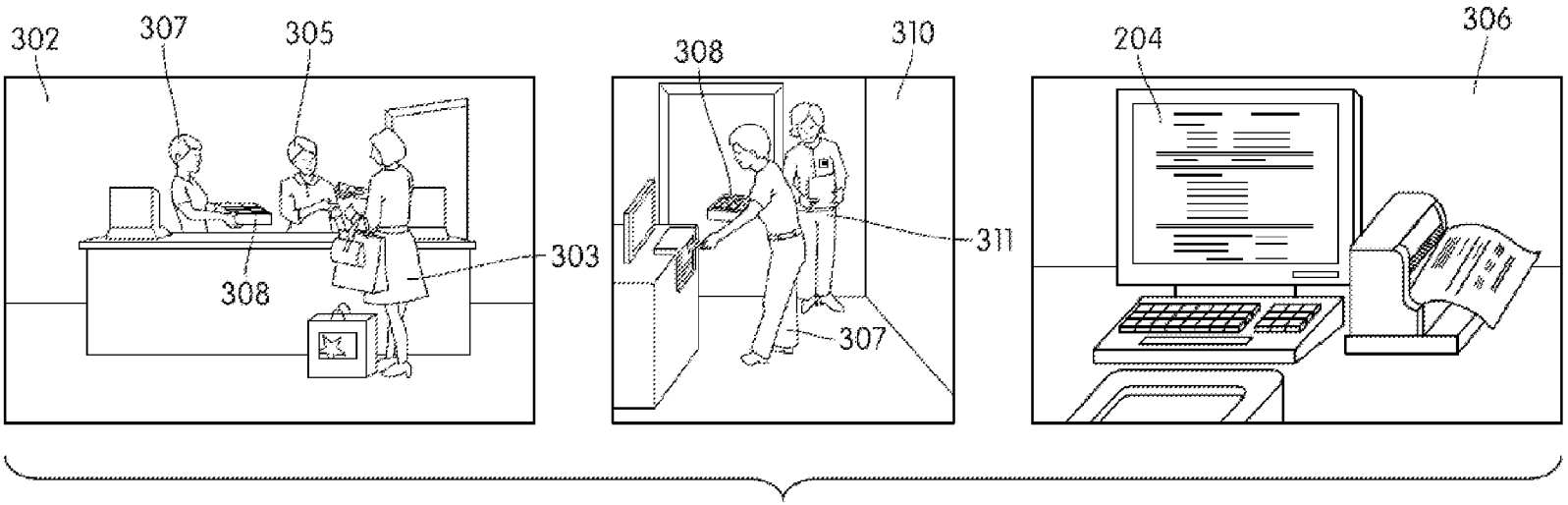
FIG. 3 illustrates various features of a currency recycler that may be used in accordance with aspects of the invention.

FIG. 3 illustrates various features of cash recycler, such as cash recycler 200 of FIG. 2, used in various aspects of the invention. The images in FIG. 3 depict use of a single cash recycler 200 in a retail environment. The retail owner may have a cash recycler 200 located in each of their stores. In an aspect of the invention, summary information for the retail owner's stores may be available via an interface to the financial institution. In another embodiment, access to summary information may be available directly from each of the cash recyclers 200.

In FIG. 3, image 302 depicts customer 303 paying cash to a retail employee such as store cashier 305 for a purchase. Another store cashier 307 at a recently closed cash register may be carrying a cash drawer or till 308 to a back office for reconciliation. In image 310, store cashier 307 may load currency from cash register till 308 into cash recycler 200. In addition, store cashier 307 may also deposit other paper forms of payment received from customer such as checks. An office manager 311 may be supervising cashier 307 during the loading of cash register till 308 into cash recycler 200. Moreover, upon the start of a shift a cashier may fill his/her cash register till with a designated amount of currency dispensed from cash recycler 200.

In image 306 of FIG. 3, a display screen (e.g., display 213 of cash recycler 200 of FIG. 2) may show the total amount entered into cash recycler 200 from till 308. The display screen 213 may breakout the amount entered into cash recycler 200 by denomination and by each cashier. The total amount deposited and withdrawn from cash recycler 200 may be shown on display screen 213.

Figure 4:
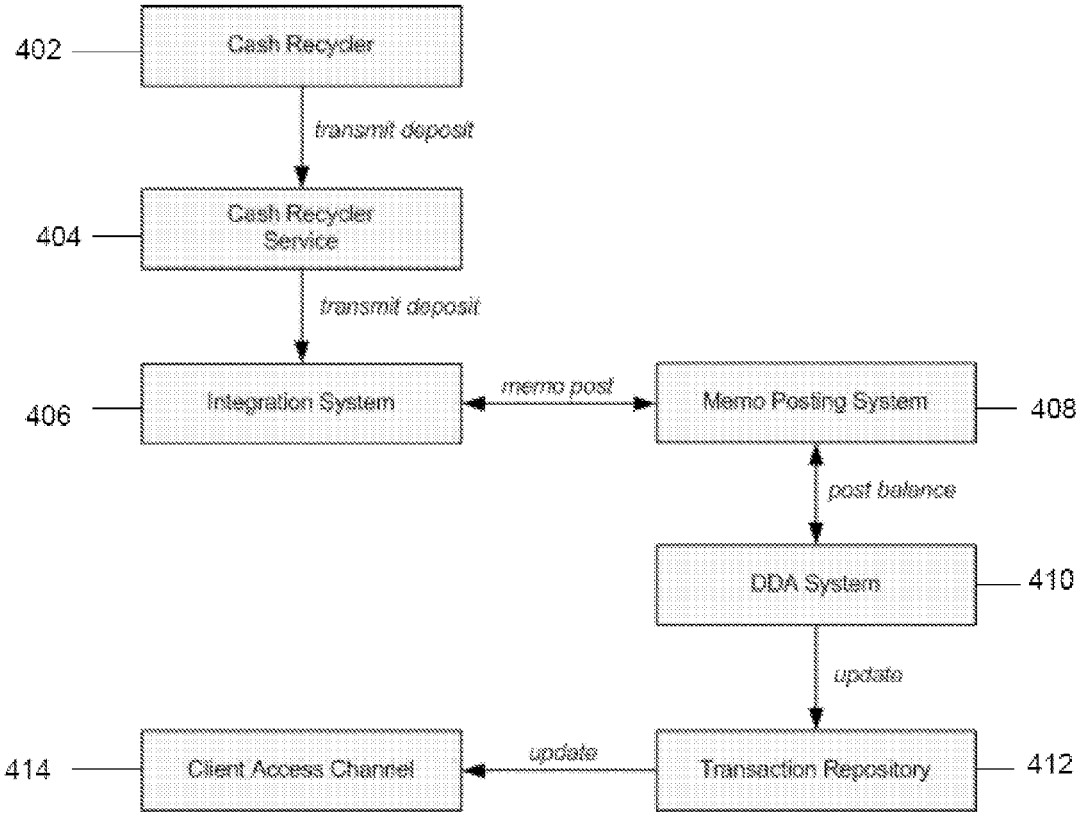
FIG. 4 illustrates a system configuration that may be used in accordance with one or more aspects described herein.

FIG. 4 illustrates a system configuration that may be used in accordance with an aspect of the invention. In FIG. 4 a cash recycler 402 may communicate information to cash recycler service 404 located at a remote location. For example, cash recycler 402 may communicate deposit and withdrawal information from an enterprise location (e.g., a retail store) to the remote cash recycler service 404. The information may be routed through various networks such as the Internet to reach the cash recycler service. The cash recycler service 404 may be located in the data center of a financial institution. The cash recycler service 404 may communicate with an integration system 406 which provides access to the financial systems and processes. The integration system 406 may communicate with a memo posting system 408 which may perform posting activity. The posting system 408 may update the appropriate DDA (direct deposit account) system 410 to reflect the balance changes in the enterprises account balances. The DDA system 410 may also update a transaction repository 412 for historical and intra-day reporting purposes. An enterprise employee may access information stored in the transaction repository 412 through a client access channel 414 via web browser. Those skilled in the art will realize that the financial institution may allow the enterprise user to access the information stored in the transaction repository via numerous alternative communication methods.

According to one aspect, cash recyclers such as cash recycler 102 (FIG. 1) and 200 (FIG. 2) and other cash handling devices may facilitate real-time recognition of funds. In particular, funds deposited at a recycler or other cash handling device at a client site may be recognized by a bank at the time the deposit is made. Recognition refers to the real credit (i.e., not provisional) of deposited funds into a client's account. In contrast to current systems, there is no delay between a deposit of funds and when the funds and transaction data are submitted to the bank for recognition. Thus, instead of having to wait until the end of the day or another prescheduled time for deposits and/or withdrawals to be recognized by the bank, each deposit is processed for recognition in real-time. Data regarding the withdrawal or deposit transaction may be transmitted through a data network to the bank for recognition and processing. Providing real-time recognition offers may advantages including the ability for a client to withdraw the same currency that was earlier deposited for use in the client's operations, all at the client site and without having to first transport the deposited funds to the bank for recognition. Currency recyclers, recycling management and recognition of funds are further described in U.S. application Ser. No. 11/614,656, entitled "Commercial Currency Handling and Servicing Management," filed on Dec. 21, 2006, the content of which is incorporated herein by reference in its entirety.

Figure 5:
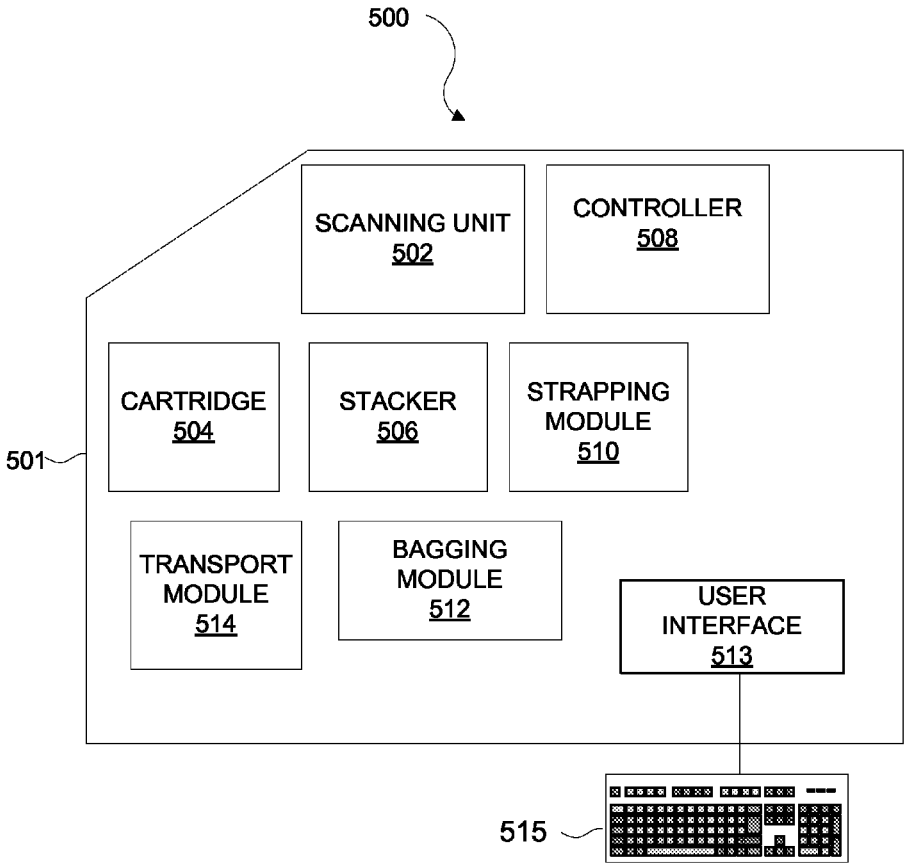
FIG. 5 is a diagram of a currency recycler including various components used in accordance with one or more aspects described herein.

FIG. 5 illustrates an example cash recycler 500. The cash recycler 500 or other currency handling device described above may include various components. For instance, the cash recycler 500 may include some or all aspects of the cash recycler 200, as shown in FIG. 2. The cash recycler 500 of FIG. 5 includes a controller 508 configured to process transactions including transmitting data to a financial institution for recognition at the financial institution, control mechanical systems of the cash recycler 500, control access to one or more portions of recycler 500, reconcile logical and physical counts of funds and the like. The controller 508 may be an external component or may be integrated into the cash recycler 500. The controller 508 generally includes a processor and memory such as RAM and ROM (not shown). In addition, the controller 508 may include or have access to storage and include user interface 513. The user interface 513 may include a display as well as various input devices such as a keyboard 515, mouse, and others. In some arrangements, the display may be a touch-sensitive display thereby allowing user input to be received through the display. Additionally or alternatively, the user interface 513 may be configured to receive voice commands. The controller 508 may further be configured to control various peripheral devices, such as a printer, external storage device, speakers and the like using one or more adapters and interfaces (not shown).

The controller 508 is further configured to execute software for providing functionality to the cash recycler 500. For instance, the controller 508 may execute commands as directed by the software instructions to control transactions made using the currency recycler 500, communicate with the financial institution or other entity, provide outputs via the user interface 513 or a peripheral device, such as a printer, and also to physically move the currency within the cash recycler 500.

In one example, a user may deposit $1000 into the cash recycler 500. The user provides input through the user interface 513 regarding the deposit. This user input may include selection from a display, voice commands, and the like. The money is then deposited into the cash recycler 500. In one arrangement, the controller 508, in response to various instructions provided by software, may control the mechanical systems of the cash recycler 500, as well as the electronic (e.g., a communications interface) systems of the cash recycler 500. For instance, the controller 508 may operate the mechanical system that controls the flow of currency into the machine during a deposit. In another arrangement, the controller 508 may house the software configured to send and receive transaction data between recycler 500 and a remote device through a communication interface. In addition, the controller 508 controls the scanning device 502 to scan each bill inserted into the cash recycler 500 to confirm authenticity and to verify the condition of the bill. If a bill is deemed to be an unauthorized reproduction, it may be removed from circulation and stored in a separate region of the cash recycler 500. In particular, the controller 508 may engage various mechanical systems such as automated rollers to store the bill in the separate region. If the bill is deemed too worn to be returned to circulation, the mechanical systems operated by the controller 508 may remove the bill and place it in a separate region for storage. If the bill is deemed suitable to return to circulation it may remain or be placed with the bills in the recycler 500 that are eligible for recirculation from recycler 500. Further, controller 508 may reconcile a deposit amount specified by a depositing user and a physical count of the currency actually deposited to insure accuracy and integrity. In addition, the controller 508 may store data related to the amount of currency inserted into the cash recycler 500, as well as the amount of currency removed from circulation for various reasons. In still other examples, the controller 508 may aid in transmitting the cash transaction information to the financial institution. Additionally or alternatively, the controller 508 may forward a communication, such as an email, to an email box reporting the cash transaction. In still other arrangements, the controller 508 may forward a report of the cash transaction to a peripheral device, such as a printer, to print the report as a record of the cash transaction.

Additionally or alternatively, access to the various functions of the cash recycler 500 may be password protected or may require other authorization and authentication before a user may perform or adjust those functions. In one arrangement, biometric data, such as fingerprint, iris scan, and the like, may be used to authenticate a user of the cash recycler 500 to permit adjustment to various settings. In addition, access to the internal portion of the cash recycler 500 may be restricted to only authorized users. The cash recycler 500 may include one or more locks to prevent unauthorized access to the internal portion of the cash recycler 500. Integrating the controller 508 within the cash recycler 500 provides such additional security to prevent unauthorized access to the computer systems and internal portion of the cash recycler 500 and reduces the ability of would-be intruders to obtain unauthorized access to the controller 508 and bypass such security measures.

As further illustrated in FIG. 5, a cash recycler 500 may include a strapping module 510 in which various currency bills or other funds, such as checks and the like, may be bundled together for organization and transport. The number or amount of funds bundled together may be preconfigured. For instance, a retailer may desire to have 100 of each denomination of bill bundled together. In such an arrangement, 100 $1 bills, 100 $5 bills, 100 $10 bills, 100 $20 bills, 100 $50 bills, and the like would be automatically bundled together. Alternatively, the number or amount of funds to be bundled may be determined automatically based on a size of a strapping element.

Figure 6A:
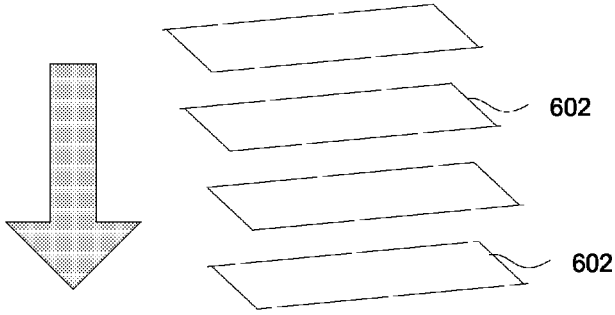
FIGS. 6A-6C are diagrams of a bill strapping process according to one or more aspects described herein.
Figure 6B:
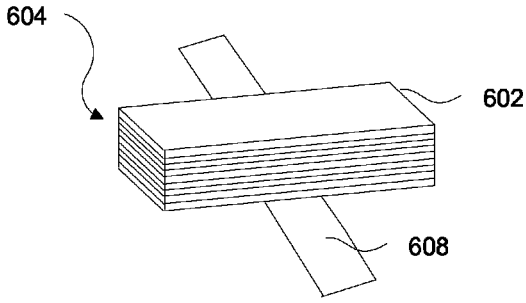
Figure 6C:
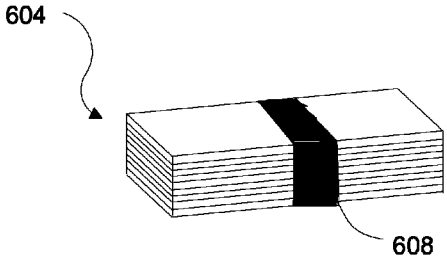

FIGS. 6A-6C are schematic flow diagrams of processes that may be facilitated by the strapping module 510 of the cash recycler 500. In one arrangement, the number of bills to be bundled may be transported to the strapping module 510. For instance, upon reaching a threshold of number of bills of a denomination, that number of bills may be transferred from the stacker 506 or other active storage unit of the cash recycler 500, to the strapping module 510. Transferring the bills may be accomplished using a variety of known means of moving currency including rollers, conveyors, and the like. Upon reaching the strapping module 510, the bills may be stacked into units having the specified number of bills in each unit. As shown in FIG. 6A, the bills 602 may be stacked using known methods of stacking In one arrangement, the bills 602 may be stacked by a conveyor 604 that drops the bills onto a bills stacking area. As each bill falls from the conveyor, it will fall onto the previous bill, until the specified number of bills is reached. In other arrangements, any known industry method of strapping funds may be used.

In FIG. 6B, the bills 602 have been stacked into a unit 604. In arrangements where the bills 602 are stacked in a stacking area, straps 606 or bands may be arranged across the strapping area. These straps 606 or bands may be used to secure the bundled unit 604 of bills 602 together. In the arrangement of FIG. 6B, one or more straps 606 may be laid substantially horizontally across the stacking area. As the bills 602 are stacked, they will come to rest on the one or more straps 606. In FIG. 6C, the strap 606 may be wrapped around the stack of bills 602 or funds to secure the stacked unit 604. Wrapping of the strap 606 may be done using known automated strapping methods. Once wrapped, the strap 606 may be secured. For instance, the strap 606 may include an adhesive portion that, when in contact with a non-adhesive portion of the strap 606 or a corresponding adhesive portion on an opposite end of the strap, will secure the strap 606 in place.

Once the unit 604 of stacked bills 602 is wrapped with the strap 606 and the strap 606 is secured, the unit 604 may be transferred to a storage area or module. If the unit 604 is to be transported, the bills 602 may be automatically transferred to a bagging module 512 wherein a plurality of stacks of funds may be placed in bags for transport. The bagging process and module will be discussed more fully below. Additionally or alternatively, the strapping or bundling could occur as the notes enter the overflow cartridge. In this arrangement, the notes may not be separated by denomination but would allow for the carrier to quickly remove the strapped funds and/or the cartridge containing the strapped funds. The funds could then be verified at the financial institution, cash vault, and others.

Figure 7:
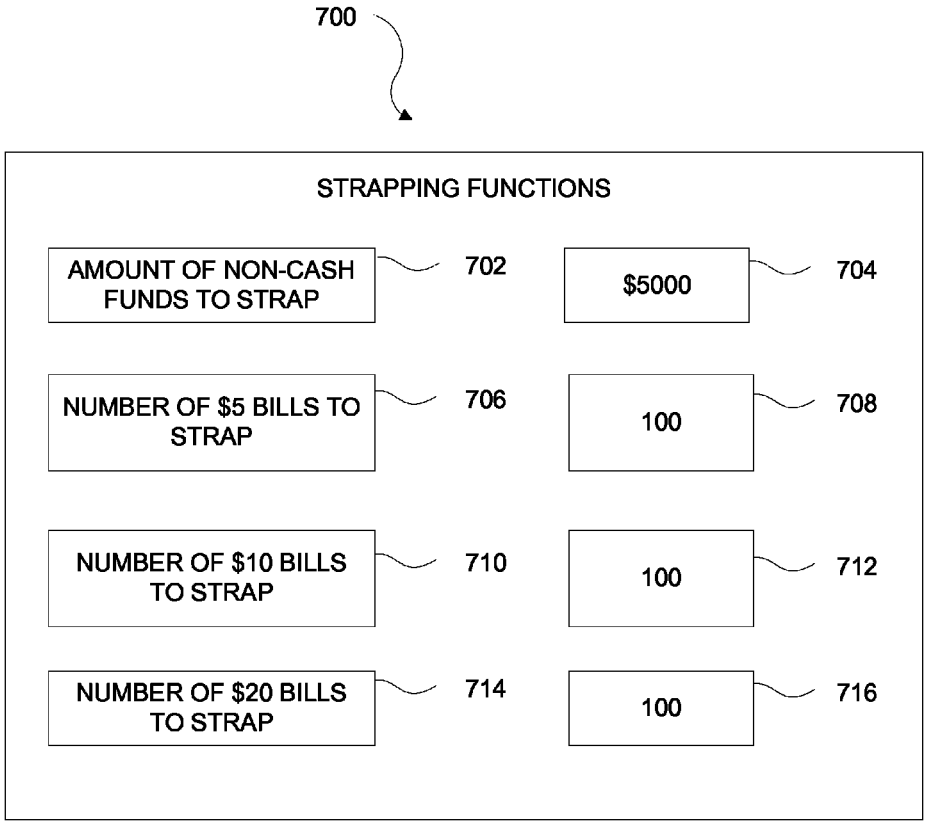
FIG. 7 is an example user interface for configuring various aspects and functions of the automatic bill strapping process according to aspects described herein.

As discussed above, the cash recycler 500 may include a user interface (such as 513 in FIG. 5). FIG. 7 illustrates one example user interface 700 in which a user may preconfigure the number of bills or amount of funds that will be strapped in a bundle. For instance, field 702 indicates that a user may preconfigure the amount of funds non-cash funds to be bundled. A user may input, in field 704, the number of non-cash funds, such as checks and the like, that will be bundled. As one or more non-cash item is received in the cash recycler, it will be stored until enough non-cash items are accumulated to meet the preconfigured threshold. Once the threshold shown in field 704 is met, the non-cash funds will be transferred to the stacking module where they will be stacked and bundled as described above.

Fields 706, 710, and 714 allow a user may preconfigure the number of $5, $10, and $20 bills, respectively, that will be wrapped in each bundle. For instance, field 708 indicates that the user has preconfigured the cash recycler to include 100 $5 bills in each bundle. Field 712 indicates that the user has preconfigured the cash recycler to include 50 $10 bills in each bundle and field 716 indicates that 25 $20 bills should be strapped in each bundle. A user may alter the preconfigured number of bills, or amount of money, using known means of inputting values, such as clicking or double-clicking in the field and typing in the number of bills or amount, selecting the number of bills from a drop-down menu, selecting a radio button associated with the desired value, and the like. The user interface 700 shown in FIG. 7 is simply one example of a user interface 700 that may be used to preconfigure the number of bills or amount of funds to be bundled.

Figure 8:
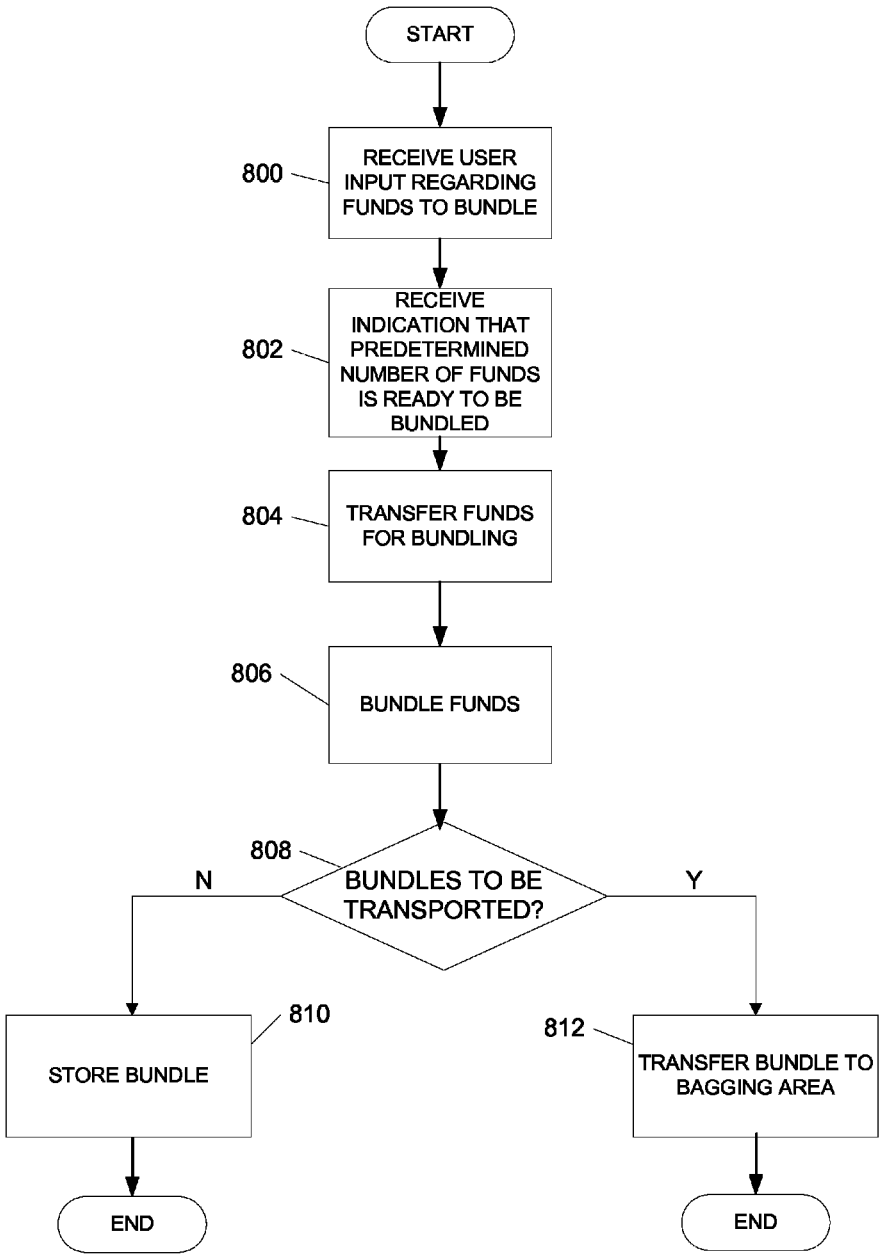
FIG. 8 illustrates a method for automatically strapping bills together according to aspects described herein.

FIG. 8 illustrates one example method of bundling funds in a cash recycler. In step 800, user input is received indicating the number of each denomination to be bundled or the amount of cash or non-cash funds to be bundled. In step 802, the cash recycler receives an indication that the preconfigured number of bills is contained in one or more storage areas or stackers of the cash recycler. The preconfigured number of bills is then transferred to a strapping module in step 804. The preconfigured number of bills is then strapped together as a unit in step 806. In step 808 a determination is made as to whether the strapped stack of bills will be transported from the cash recycler or if it will remain in storage in the cash recycler. If the strapped unit it to be transported, the bundle will be transferred to a bagging area in step 812. If the bundle is to remain in storage in the cash recycler, the bundle may be transferred to the appropriate storage area in step 810.

Figure 9A:
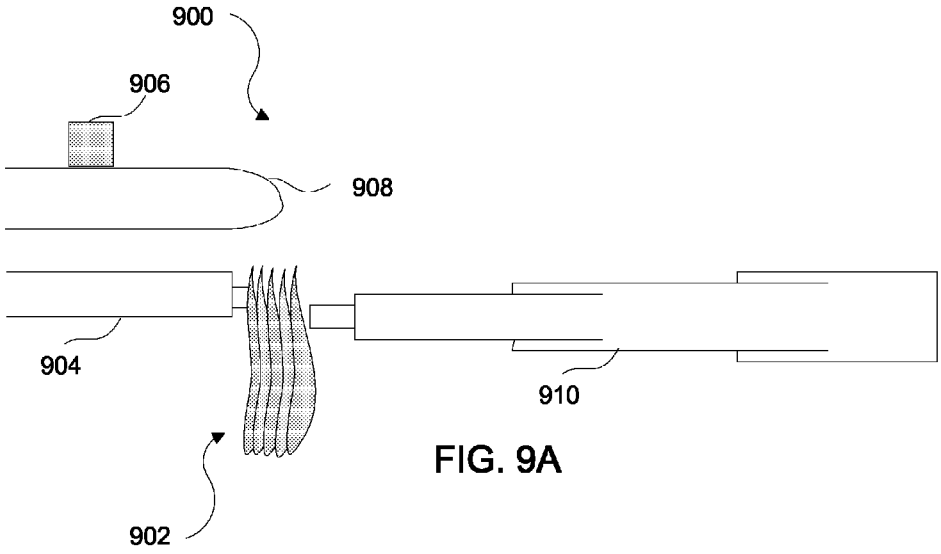
FIGS. 9A-9C are diagrams of an example automatic bagging process according to aspects described herein.
Figure 9B:
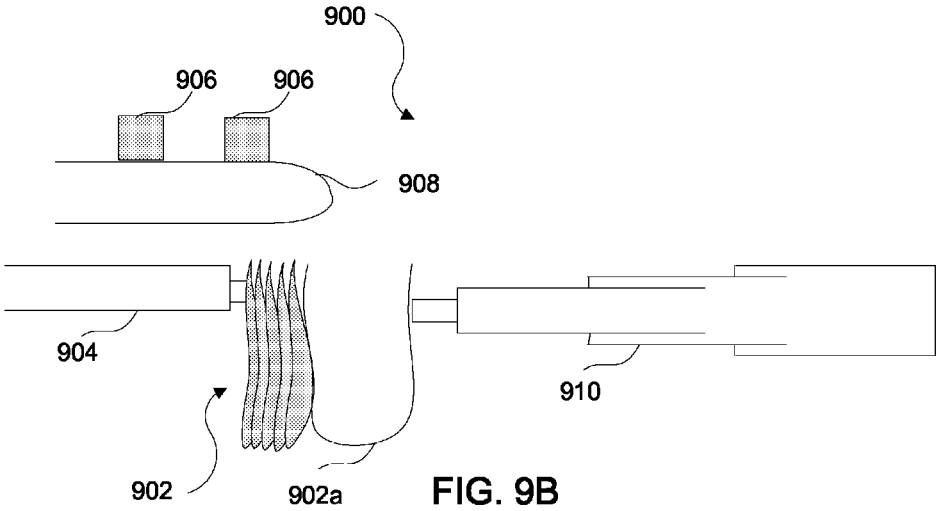
Figure 9C:
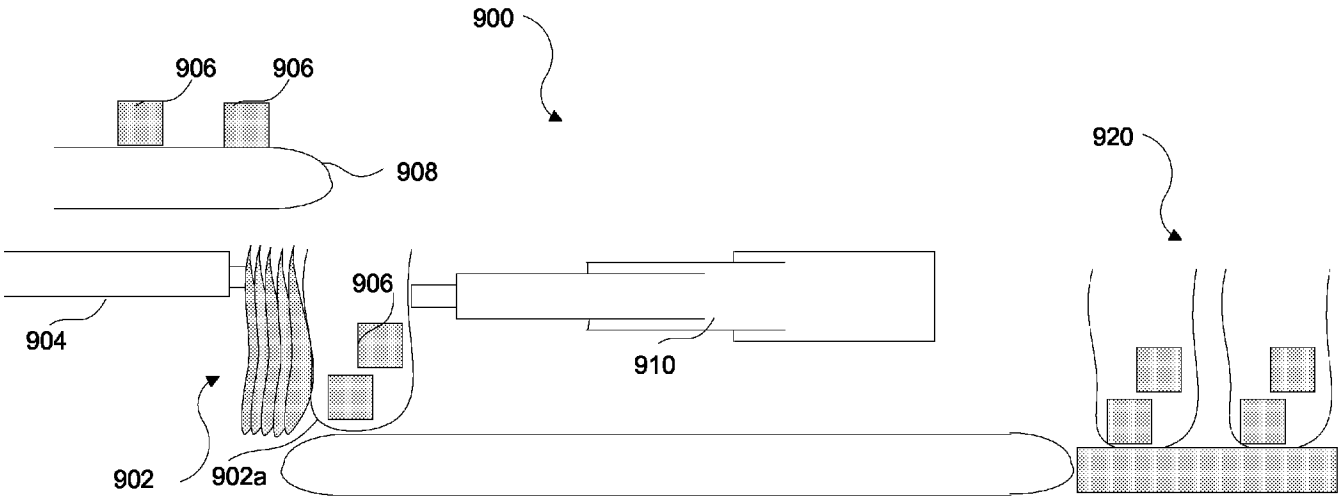

One or more bundles or units of stacked bills that have been strapped together may be transferred to a bagging module in order to be bagged in preparation for transport. FIGS. 9A-9C are schematic diagrams of a bagging process that may be used to automatically bag any bundles of funds that are to be transported from the cash recycler. For instance, once a threshold number of bundles has been reached, the cash recycler may automatically transfer the bundles from a storage area or the strapping area to a bundling module. Once in the bundling module, one or more bundles of funds may be placed in bags or other containers for transport by way of the example bagging process in FIGS. 9A-9C or other similar process. For example, an individual such as a transport carrier employee may remove the bag or container of funds and deliver it to a financial institution.

In the example process shown in FIGS. 9A-9C, one or more bags 902 may be arranged in the bagging module 900. In the arrangement shown, a plurality of bags 902 is hung together from a first arm 904 of the bagging module 900. The bundles 906 of funds may be transferred to the bagging module 900 via known means of conveyance, such as rollers, conveyor belts, such as conveyor 908, and the like. Once one or more bundles 906 have reached the bagging module 900, a bag 902*a* will be opened by separating one side from the other, to receive the bundles 906, as shown in FIG. 9B. The bag 902*a* may be opened using known means of separation. In one arrangement, an arm 910 or other device may reach across a void to connect to one side of the bag 902*a*. In one arrangement, the arm 910 may be a telescoping arm configured to expand and retract across the void. The arm 910 will then grasp one side of the bag 902*a* and retract to the other side of the void, thereby separating the two sides of the bag and providing an opening to receive the bundles 906. Once the bag 902*a* is open, the one or more bundles 906 may be transferred to the bag 902*a*, such as on a conveyor belt 908, series of rollers, and the like, as shown in FIG. 9C. Once a predetermined amount of money or number of bundles is contained within the bag 902*a* or container, the bag 902*a* will be released from the arms 904, 910 or devices holding the bag 902*a*, i.e. the arms 904, 910 may retract past a certain point to release the hold on each side of the bag 902*a*, and will be transferred to a separate storage area 920 to await removal and transport. In one arrangement, the bag 902*a* may remain in an open configuration until removed from the cash recycler. This open arrangement allows an individual transporting the bag to have visual confirmation of the contents of the bag prior to closing and securing the bag. In other arrangements, the bag may be automatically closed in the cash recycler using known methods of closure, such as adhesives, and the like.

In one arrangement, the cash recycler may transmit an indication that the predetermined number of bags is contained within the transport storage area 920. This indication may include an email message transmitted to a financial institution, a message transmitted to a printer associated with the cash recycler, an indication shown on the user interface of the cash recycler, and the like. Once the indication has been transmitted, a pick up of the bags may be arranged.

In one or more arrangements described herein, the bags may include an identifier, such as a radio-frequency identification (RFID) tag. The RFID tag may be inserted into each bag and may include information relating to the contents of the bag associated with the tag. For instance, the RFID tag may include information identifying the bag, as well as information regarding the amount of money in the bag, the denomination of bills in the bag, and other information. In some arrangements, the RFID tag may be inserted in the bag manually. In other arrangements, the RFID tag may be automatically inserted into the bag.

Figure 10:
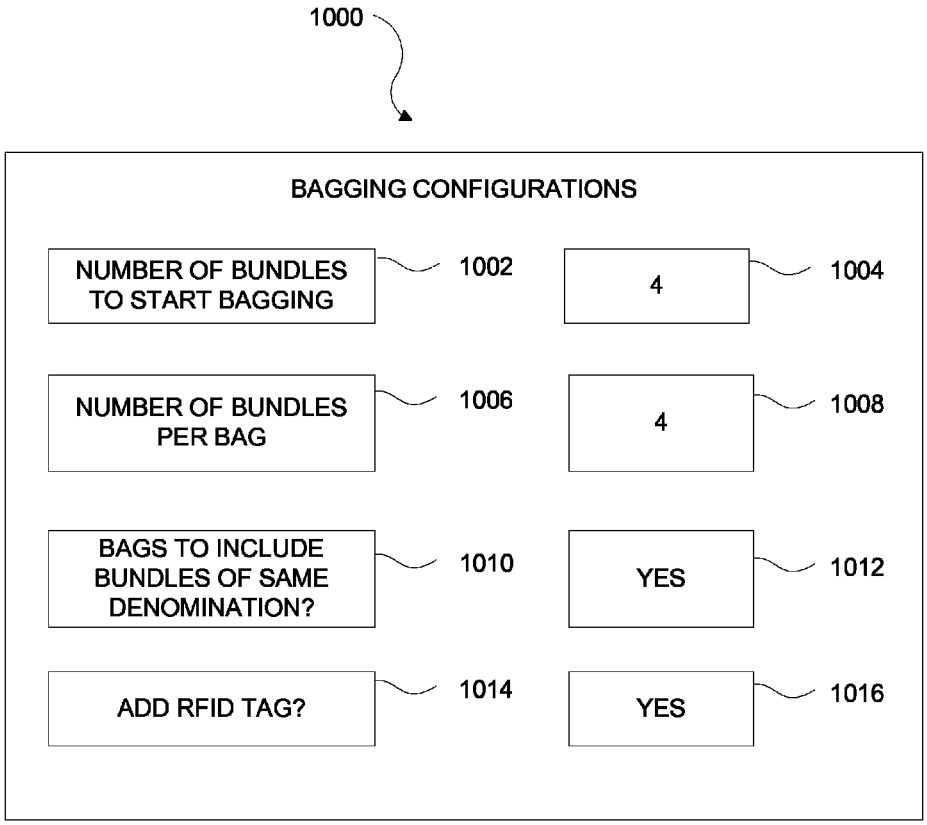
FIG. 10 is an example user interface for configuring various aspects and functions of the automatic bagging process according to aspects described herein.

FIG. 10 illustrates one example user interface that may be used in accordance with aspects described herein. The user interface of FIG. 10 provides several example functions associated with the bagging operations of the cash recycler that may be preconfigured to facilitate the automatic bagging process. In field 1002, the user may determine the threshold number of bundles to initiate the automatic bagging process. In field 1004, the user has determined that 4 bundles should be formed to initiate the automatic bagging process. In field 1006, the user may select the number of bundles in each bag. Field 1008 indicates that a user has selected 4 bundles per bag. In field 1010, the user may select whether each bag will include only bundles of the same denomination or if bundles of bills of various denominations will be mixed together in a single bag. In field 1012, the user has indicated that all bundles in a given bag will be the same denomination. In field 1014, the user may determine whether to include and RFID tag or other identifier in each bag. Field 1016 indicates that the user has selected to insert an RFID tag into each bag. Similar to the user interface described above, a user may make selections using known means, such as clicking or double-clicking in a field and inserting the desired number or configuration. In other arrangements, the user may select a configuration from a drop-down menu or may select a radio button associated with a desired selection.

Figure 11:
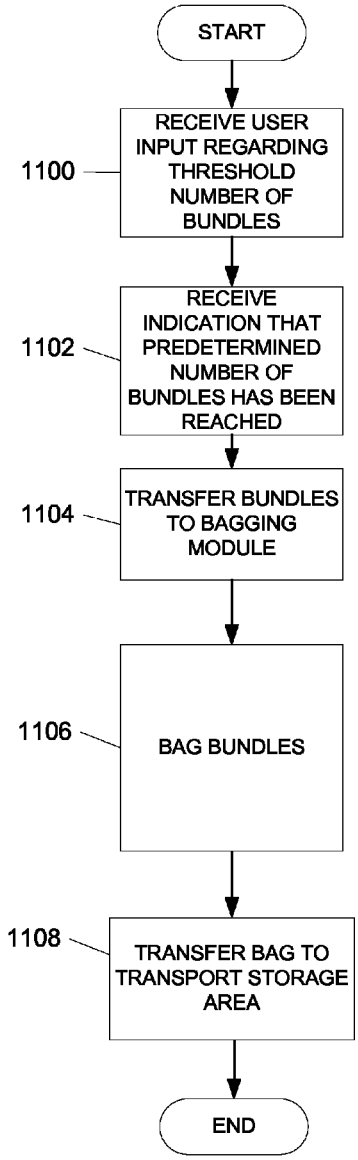
FIG. 11 illustrates a method of automatically bagging strapped bills according to aspects described herein.

FIG. 11 illustrates one method of automatically bagging bundles of cash or funds according to aspects described herein. In step 1100, user input is received regarding a threshold number of bundles or stacks of bills in the cash recycler to initial automatic bagging of the bundles. In step 1102, an indication is received that the predetermined threshold number of bundles is contained within the cash recycler. Once this threshold is reached, automatic bagging of the bundles is initiated. In step 1104, the predetermined number of bundles to be bagged is transferred to the bagging module. In step 1106, the bag is opened and the predetermined number of bundles is placed in the bag. In step 1108 the bag containing the predetermined number of bundles is transferred to a transportation storage area from where the bag will be removed and transported.

Figure 12:
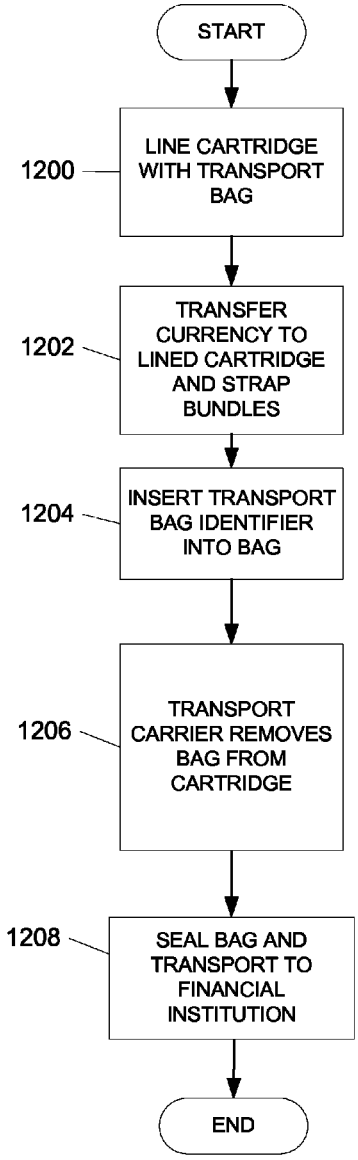
FIG. 12 illustrates an example method of strapping and bagging funds according to aspects described herein.

FIG. 12 illustrates yet another example arrangement of a method of strapping and bagging funds. In step 1200, a cartridge, such as an overflow cartridge is lined with a transport bag. In some arrangements, the bag includes a means for sealing the bag, such as an adhesive, zipper, tie, hook and loop, or other closure mechanism. In step 1202, currency may be transferred from one or more recycling units to the cartridge and strapped together in bundles. For instance, the currency may be strapped together by denomination or by total currency in a bundle. The bundling of the currency may be configured by a user. The strapped bundles will be contained within the transport bag. In step 1204, a transport bag identifier may be inserted into the bag. The identifier may be a bar code, receipt indicating information about the transport bag, RFID tag, and the like. In step 1206, a carrier or other transport individual will remove the bag from the cartridge. In step 1208 the bag will be sealed and transported to the financial institution.

In some arrangements, the transport bag may automatically seal after the funds and/or identifier have been inserted. In still other examples, the sealed bag may remain in the cartridge and another bag may be filled and sealed in the same cartridge. This process may continue until a predetermined number of bags are filled. The carrier can then remove the bags. This process may be conducted on a schedule that coincides with the transport carrier schedule.

Although not required, one of ordinary skill in the art will appreciate that various aspects described herein may be embodied as a method, a data processing system, or as one or more computer-readable media storing computer-executable instructions. Accordingly, those aspects may take the form of an entirely hardware embodiment, an entirely software embodiment or an embodiment combining software and hardware aspects. In addition, various signals representing data or events as described herein may be transferred between a source and a destination in the form of light and/or electromagnetic waves traveling through signal-conducting media such as metal wires, optical fibers, and/or wireless transmission media (e.g., air and/or space).

Aspects of the invention have been described in terms of illustrative embodiments thereof. Numerous other embodiments, modifications and variations within the scope and spirit of the appended claims will occur to persons of ordinary skill in the art from a review of this disclosure. For example, one of ordinary skill in the art will appreciate that the steps illustrated in the illustrative figures may be performed in other than the recited order, and that one or more steps illustrated may be optional in accordance with aspects of the disclosure.

Aspects of the present disclosure relate to cash handling devices. Cash handling devices generally refer to devices that are configured to accept and/or dispense currency. Cash handling devices include payment kiosks, point of sale systems such as cash registers, automated teller machines (ATMs), currency recyclers and depository machines, and the like. Currency recyclers generally refer to cash handling devices that are configured to dispense the same currency that was earlier deposited. For example, if a user deposits a 5 dollar bill into a cash recycler machine, the same 5 dollar bill may be dispensed during a subsequent withdrawal transaction. Thus, using currency recyclers, deposited currency may be placed immediately back into use and circulation instead of being held or frozen until a bank is able to collect and reconcile the funds, stored indefinitely and/or taken out of circulation entirely as is the case with other current cash handling devices.

What is claimed is:

1. An apparatus, comprising:

at least one processor; and memory operatively coupled to the at least one processor and storing computer readable instructions that, when executed, cause the apparatus to:

receive a plurality of bills;

dispense, in response to receiving a request from a user, at least one bill of the received plurality of bills;

collect bundles of funds, wherein each of the bundles of funds includes a plurality of undispensed bills of the received plurality of bills;

determine that a number of the bundles of funds has reached a predetermined threshold number of bundles of funds;

responsive to determining that the predetermined threshold number of bundles of funds has been reached, automatically initiate an automatic bagging process;

automatically transfer the predetermined threshold number of bundles of funds to a bagging area;

automatically bag the predetermined threshold number of bundles of funds in at least one bag; and automatically transfer the at least one bag to a storage area.

2. The apparatus of claim 1, further including a radio-frequency identification tag inserted into the at least one bag.

3. The apparatus of claim 1, wherein the instructions, when executed, further cause the apparatus to receive user input identifying the predetermined threshold number of bundles of funds.

4. The apparatus of claim 3, wherein the user input is received via a touch-sensitive display.

5. The apparatus of claim 1, wherein the instructions, when executed, further cause the apparatus to automatically open the at least one bag prior to automatically bagging the predetermined threshold number of bundles of funds.

6. The apparatus of claim 1, wherein the instructions, when executed, further cause the apparatus to close the at least one bag after automatically bagging the predetermined threshold number of bundles of funds.

7. The apparatus of claim 6, wherein closing the at least one bag further including connecting one side of the at least one bag with another side of the at least one bag using an adhesive.

8. The apparatus of claim 1, wherein the instructions, when executed, further cause the apparatus to:

determine whether each bag is to include bundles of funds of a same denomination or bundles of funds of different denominations; and automatically bag the predetermined threshold number of bundles of funds based on the determination.

9. The apparatus of claim 1, wherein the predetermined threshold number of bundles of funds is a first predetermined threshold number of bundles of funds, and wherein the instructions, when executed, further cause the apparatus to:

automatically bag the first predetermined threshold number of bundles of funds based on a second predetermined threshold number of bundles of funds, wherein the second predetermined threshold number of bundles of funds indicates the number of bundles of funds to be placed in each bag, and wherein the second predetermined threshold number of bundles of funds is different from the first predetermined threshold number of bundles of funds.

10. A method of bagging at least one bundle of currency, comprising:

receiving a plurality of bills;

dispensing, in response to receiving a request from a user, at least one bill of the received plurality of bills;

collecting bundles of funds, wherein each of the bundles of funds includes a plurality of undispensed bills of the received plurality of bills;

determining that a number of the bundles of funds has reached a predetermined threshold of number of bundles of funds;

responsive to determining that the predetermined threshold number of bundles of funds has been reached, automatically initiating an automatic bagging process;

automatically transferring the predetermined threshold number of bundles of funds to a bagging area;

automatically bagging the predetermined threshold number of bundles of funds in at least one bag; and automatically transferring the at least one bag to a storage area.

11. The method of claim 10, further including inserting a radio-frequency identification tag into the at least one bag.

12. The method of claim 10, further including receiving user input regarding the predetermined threshold number of bundles of funds.

13. The method of claim 12, wherein the user input is received via a touch-sensitive display.

14. The method of claim 10, further including automatically opening the at least one bag prior to automatically bagging the predetermined threshold number of bundles of funds.

15. The method of claim 10, further including closing the at least one bag after automatically bagging the predetermined threshold number of bundles of funds.

16. The method of claim 15, wherein closing the at least one bag further including connecting one side of the at least one bag with another side of the at least one bag using an adhesive.

17. One or more non-transitory computer-readable media storing computer readable instructions that, when executed, cause a bagging system to:

receive a plurality of bills;

dispense, in response to receiving a request from a user, at least one bill of the received plurality of bills;

collect bundles of funds, wherein each of the bundles of funds includes a plurality of undispensed bills of the received plurality of bills;

determine that a number of the bundles of funds has reached a predetermined threshold number of bundles of funds;

responsive to determining that the predetermined threshold number of bundles of funds has been reached, automatically initiate an automatic bagging process;

automatically transfer the predetermined threshold number of bundles of funds to a bagging area;

automatically bag the predetermined threshold number of bundles of funds in at least one bag; and automatically transfer the at least one bag to a storage area.

18. The one or more non-transitory computer readable media of claim 17, wherein the instructions, when executed, further cause the bagging system to insert a radio-frequency identification tag into the at least one bag.

19. The one or more non-transitory computer readable media of claim 17, wherein the instructions, when executed, further cause the bagging system to receive user input identifying the predetermined threshold number of bundles of funds.

20. The one or more non-transitory computer readable media of claim 19, wherein the instructions, when executed, further cause the bagging system to receive the user input via a touch-sensitive display.

21. The one or more non-transitory computer readable media of claim 17, wherein the instructions, when executed, further cause the bagging system to automatically open the at least one bag prior to automatically bagging the predetermined threshold number of bundles of funds.

22. The one or more non-transitory computer readable media of claim 17, wherein the instructions, when executed, further cause the bagging system to close the at least one bag after automatically bagging the predetermined threshold number of bundles of funds.

23. The one or more non-transitory computer readable media of claim 22, wherein the instructions, when executed, further cause the bagging system to close the at least one bag by connecting one side of the at least one bag with another side of the at least one bag using an adhesive.

* * * * *